US006435381B1

(12) United States Patent
Waldman

(10) Patent No.: US 6,435,381 B1
(45) Date of Patent: Aug. 20, 2002

(54) DRY FOODSTUFF DISPENSER

(76) Inventor: Harold Waldman, 39 Gretman Crescent, Thornhill, Ontario (CA), L3T 5L9

( * ) Notice: Subject to any disclaimer, the term of this patent is extended or adjusted under 35 U.S.C. 154(b) by 0 days.

(21) Appl. No.: 09/635,523

(22) Filed: Aug. 9, 2000

(51) Int. Cl.[7] ..... B67D 3/00
(52) U.S. Cl. ..... 222/505
(58) Field of Search ..... 222/505, 508, 222/517; 251/175

(56) References Cited

U.S. PATENT DOCUMENTS

| | | | | | |
|---|---|---|---|---|---|
| 45,388 | A | * | 12/1864 | Chambers | 222/505 |
| 385,328 | A | * | 6/1888 | Robertson et al. | 222/517 |
| 543,182 | A | * | 7/1895 | Hunt | 222/505 |
| 690,280 | A | * | 12/1901 | Hendrickson | 222/505 |
| 1,164,495 | A | * | 12/1915 | Kendall | 222/505 |
| 1,468,303 | A | * | 9/1923 | King et al. | 222/505 |
| 2,479,347 | A | * | 8/1949 | Gotham | 222/505 |
| 2,882,060 | A | * | 4/1959 | Speicher | 222/505 |
| 3,255,938 | A | * | 6/1966 | Dimmich et al. | 222/505 |

* cited by examiner

*Primary Examiner*—Lesley D. Morris
*Assistant Examiner*—Thach H. Bui
(74) *Attorney, Agent, or Firm*—Riches, McKenzie & Herbert LLP

(57) ABSTRACT

A dispenser for storing and dispensing dry foodstuffs includes a hopper and a free flow ball-type dispensing mechanism. The hopper chamber is configured for store shelf use having planar front and side panels. An exit orifice is formed in a lower portion of the hopper and most preferably at a lower front portion. The dispensing mechanism is positioned over the exit orifice and is selectively operable to regulate the dispensation of foodstuffs to the consumer. The dispensing mechanism is characterized by a covering housing and an internal gate mechanism. The covering housing includes a generally semi-spherical portion with an opening therethrough and an anchoring flange. The covering housing is secured over the hopper exit orifice such that foodstuffs move downwardly from the hopper chamber under gravity, through the exit orifice and into the interior of the semi-spherical portion of the covering housing. The gate member is selectively movable relative to the semi-spherical portion between a position where it substantially overlies and blocks an outlet opening in the semi-spherical portion to prevent movement of foodstuffs therethrough, and an open position wherein the gate member is moved at least in part therefrom, permitting the free flow of foodstuffs from the interior of the covering housing outwardly through the opening. A handle secured to the gate member projects outwardly through a slot formed through the covering housing where it may be grasped by a user, and wherein the slot extends in a plane which is generally perpendicular to the lateral width of the hopper to which the ball dispenser is mounted.

19 Claims, 4 Drawing Sheets

32
34
28

10
30
12
26
24
h
22
14
64
90
20
44
16
36
58
47
46
d
w
35

DRY FOODSTUFF DISPENSER

SCOPE OF THE INVENTION

The present invention relates to a dispenser for dry foodstuffs, and more particularly a dispenser for whole or ground coffee beans having an improved free flow ball-type dispensing mechanism.

BACKGROUND OF THE INVENTION

Dispensers for storing and dispensing whole or ground coffee beans are well known. Such coffee dispensers include a hopper which is sized to hold a desired supply of coffee, and a dispensing mechanism which typically is secured to a lower portion of the front panel of the hopper. In operation, the coffee beans move under gravity through an opening formed in a lower portion of the hopper and past the dispensing mechanism to the user. Dispensing mechanisms are either of a controlled portion dispensing type which when operated, dispense a predetermined volume of coffee, or a free flow dispensing type, which are operable to provide a continuous flow of coffee from the hopper.

Free flow dispensers include ball-type dispensers which are characterized by a semi-spherical housing and a cover. The cover has a complementary shape to that of the housing and is secured in overlying juxtaposition thereto at a pivot aligned with the forwardmost apex of the cover. The cover is moved relative to the housing to selectively permit the flow of coffee therethrough. The housing includes a radially extending flange and in assembly, the housing is mechanically secured to the front panel of the hopper by the insertion of screws through the peripheral flange and into the front panel. The housing is open along its peripheral edge and has a radial diameter larger than the opening formed in the lower portion of the hopper to substantially cover the opening. The housing is provided with an outlet opening of a sufficient size to permit the substantially unrestricted movement of coffee therethrough.

A handle attached to a peripheral edge of the cover is used to urge the cover in rotational movement about the pivot and relative to the housing to selectively align a hole formed in the cover with the housing opening.

Prior art ball-type dispensing mechanisms suffer the disadvantage in that they are susceptible to clogging as a result of the compaction of coffee within the semi-spherical housing. As well, twisting motion of the cover imparts a rotational force on the entire dispensing mechanism in a direction parallel to the front panel to which the dispensing mechanism is secured. Over time, the twisting motion tends to loosen the connection of the housing to the hopper and may result in the accidental detachment of the dispensing mechanism.

In addition, to fit within existing grocery store shelves, conventional store shelf dispensers are typically formed with a narrow generally rectangular hopper configuration, having a lateral width of 4 to 12 inches. As such, the movement of the cover relative to the housing applies lateral forces on the hopper which, as a result of the narrow hopper width, may result in the entire coffee dispenser toppling over.

SUMMARY OF THE INVENTION

Accordingly, it is an object of the present invention to provide a dispenser for dry foodstuffs, such as whole or ground coffee beans, beans, grains, rice or the like, and which incorporates a free flow ball-type dispensing mechanism adapted to minimize compaction of the foodstuffs therein to reduce the likelihood of clogging.

Another object of the present invention is to provide a store shelf dispensing mechanism for coffee beans which may be operated without imparting significant lateral forces on the dispenser hopper.

A further object of the present invention is to provide a dispenser for dry foodstuffs which includes a hopper and a free flow ball-type dispenser mechanism secured to a front panel of the hopper, and in which the dispensing mechanism is operated by a handle which is movable through a vertical plane substantially perpendicular to that of the front panel of the hopper.

Another object of the invention is to provide a dispensing mechanism which includes a housing configured for positioning over a hopper outlet and an internally movable gate positioned between the hopper outlet and the housing, and which in operation displaces and reduces compaction of material within the interior of the housing.

To achieve at least some of the foregoing objects, the present invention resides in a dispenser for storing and dispensing dry foodstuffs, such as whole or ground coffee beans, other types of beans, grains, seeds, rice or the like. The dispenser includes a hopper which defines a chamber of a sufficient size to store a desired supply of foodstuffs and a free flow ball-type dispensing mechanism. The hopper chamber may be of almost any shape but most preferably is configured for store shelf use, having an elongated rectangular construction with generally planar front, and side panels. The height and depth of the hopper side panels are selected corresponding to the typical height and depth of store shelving to permit placement of the hopper thereon. The front and rear panels of the hopper have a height generally corresponding to that of the side panels and a reduced lateral width of between about 4 to 12 inches, and most preferably about 6 inches. An exit orifice is formed in a lower portion of the hopper and most preferably at a lower front portion. The orifice is sized to permit the substantially unrestricted movement of foodstuffs from the hopper chamber therethrough.

The dispensing mechanism is positioned over the exit orifice and is selectively operable to regulate the dispensation of foodstuffs to the consumer. The dispensing mechanism is characterized by a covering housing and an internal gate mechanism. The covering housing includes a generally semi-spherical portion having an opening therethrough and an anchoring flange. The semi-spherical portion extends forwardly from a rearwardmost peripheral edge which is in juxtaposed contact with the hopper to a forwardmost apex. The anchoring flange is coupled to and extends radially outwardly about part, and preferably the entire peripheral edge of the semi-spherical portion. The covering housing is secured over the hopper exit orifice such that foodstuffs move downwardly from the hopper chamber under gravity, through the exit orifice and into the interior of the semi-spherical portion of the covering housing.

The gate member is selectively movable relative to the semi-spherical portion to open and close the dispensing member outlet. The gate member is movable relative to the covering housing between a position where it substantially overlies and blocks the outlet opening to prevent movement of foodstuffs therethrough, and an open position wherein the gate member is moved at least in part therefrom permitting the free flow of foodstuffs from the interior of the covering housing outwardly through the opening. Preferably, the gate member is pivotally secured to the interior side of the covering housing and most preferably, the gate member includes a curved portion which has a curvature marginally smaller than that of the semi-spherical interior of the covering housing, so as to permit its substantially unrestricted pivotal movement relative thereto.

A lever, toggle, flange or other such suitable handle secured to the gate member and projects outwardly through a slot formed through the covering housing where it may be grasped by a user. The slot is formed through the semi-spherical housing so as to extend from a first end which spaced towards the peripheral edge of the spherical portion to a second other end located a distance towards the apex. Most preferably, the slot extends in a plane which is generally perpendicular to the lateral direction of the hopper to which the ball dispenser is mounted.

Although not necessary, a spring or other suitable biasing member may be provided to resiliently urge the gate member to the closed position, blocking the opening.

In operation of the dispenser, a user grasps the handle to actuate the dispensing mechanism and permit the free flow of foodstuff from the hopper. The dispensing mechanism is actuated by moving the handle along the slot and in the plane generally perpendicular to the plane of the hopper front panel. In this regard, the handle is either pulled forwardly away from the hopper or pushed rearwardly to rotate the gate member relative to the semi-spherical housing. The movement of the handle moves the gate member to the open position and permit the free flow of foodstuff from the hopper and covering housing interior mechanism. Once a desired volume of foodstuff has been dispensed, the handle is returned to rotate the gate member back to the closed position, overlying and closing the outlet orifice. Because the gate member is pivotally coupled to the interior of the covering housing, the movement of the gate member operates to dislocate and loosen any compacted foodstuffs which have moved from the hopper into the dispensing mechanism interior, minimizing the likelihood of clogging.

Accordingly, in one aspect the present invention resides in combination a hopper for storing coffee and a dispenser mechanism for dispensing coffee from said hopper, the hopper defining a chamber and an exit orifice leading from said chamber, the dispenser mechanism including, a cover member including a generally semi-spherical portion and peripherally extending flange extending radially from a peripheral edge the semi-spherical portion, the semi-spherical portion extending from the peripheral edge to an apex, the cover member being sized to substantially cover said exit orifice with the peripheral edge being secured about said exit orifice, said semi-spherical shaped portion further including a slot and a discharge opening formed therethrough, said slot extending radially from a first end spaced towards said peripheral edge to a second end spaced towards said apex, said opening being spaced from said slot and sized to permit substantially unrestricted movement of said coffee therethrough, an actuating member disposed intermediate said semi-spherical portion and said hopper, said actuating member being pivotally coupled to said cover member and being movable between a first position wherein at least part of said actuating member substantially overlies and closes said opening, and a second position wherein said part of said actuating member is at least partially spaced from said opening, a handle extending through said slot, and being coupled to the actuating member, whereby the sliding movement of the handle along with slot between the first and second ends selectively moves the actuating member between said first and second positions.

In another aspect the present invention resides in a dispenser for dry foodstuffs comprising a hopper for storing said foodstuffs and a dispenser mechanism, the hopper including a chamber and an exit orifice leading from said chamber, the dispenser mechanism including, a cover member including a generally semi-spherical portion and peripherally extending flange, the semi-spherical portion extending radially from the peripheral edge to an apex, the cover member being sized to substantially cover said exit orifice with the peripheral edge of said cover member being secured about said exit orifice, said semi-shaped portion further including a slot and an opening formed therethrough, said slot extending radially from a first end spaced towards said peripheral edge to a second end spaced towards said apex, said opening being spaced from said slot and sized to permit substantially unrestricted movement of said coffee therethrough, an actuating member disposed intermediate said semi-spherical portion and said hopper, said actuating member being pivotally coupled to said cover member and being movable between a first position wherein at least part of said actuating member substantially overlies and closes said opening, and a second position wherein said part of said actuating member is at least partially spaced therefrom, a handle extending through said slot and coupled to the actuating member, whereby the selective sliding movement of the handle along with slot between the first and second positions moves the actuating member.

DESCRIPTION OF THE DRAWINGS

Reference may now be had to the following detailed description taken together with the accompanying drawings in which.

DETAILED DESCRIPTION OF THE INVENTION

Figure 1:
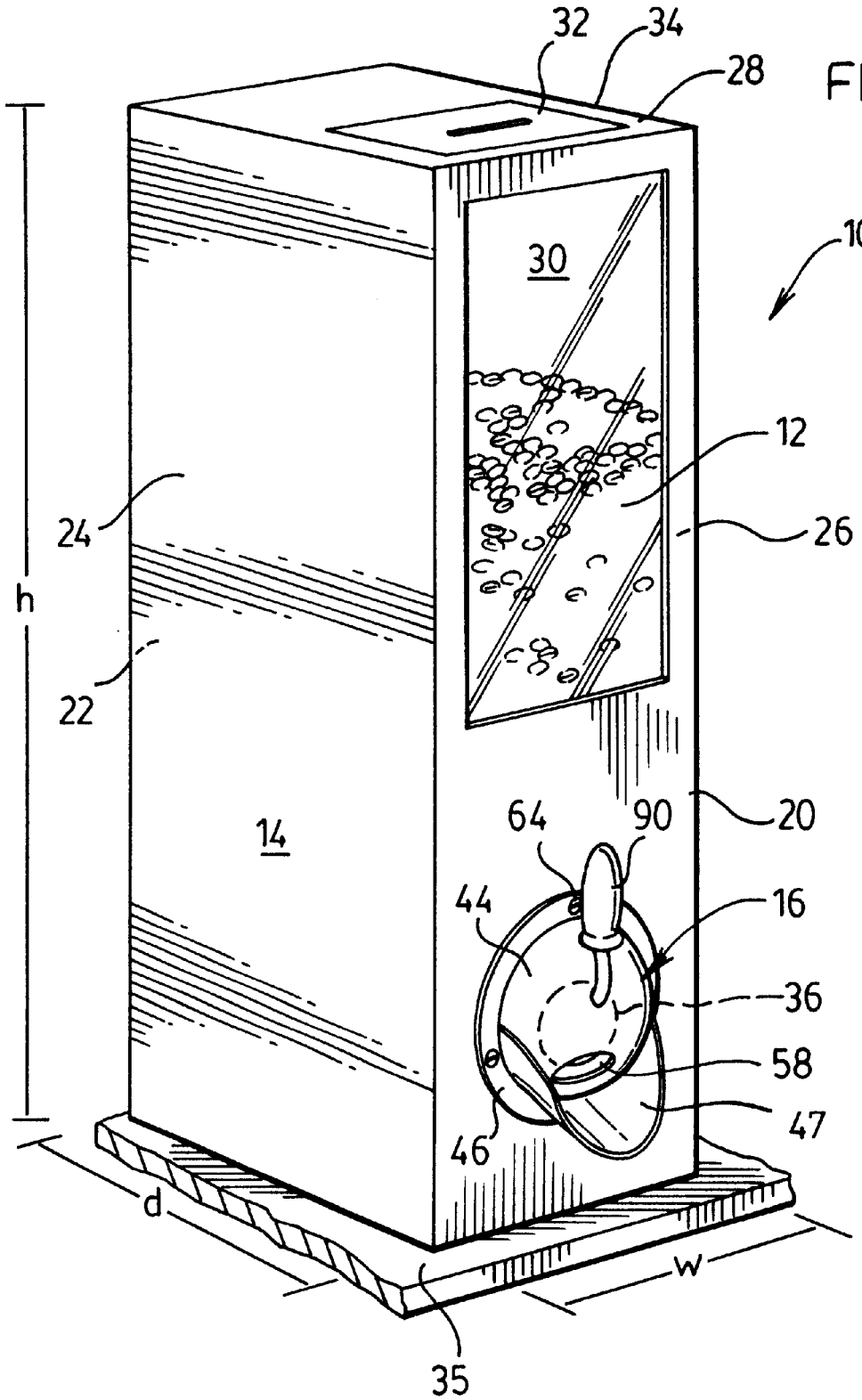
FIG. 1 shows a perspective view of a coffee bean dispenser in accordance with a preferred embodiment of the invention.

Reference is now made to FIG. 1 which shows a store shelf dispenser 10 for whole coffee beans 12 in accordance with a preferred embodiment of the invention. The dispenser 10 includes a hopper 14 and a ball-type dispensing mechanism 16 which, as will be described is used to selectively dispense the coffee beans 12 from the hopper 14.

FIG. 1 shows the hopper 14 best as having a generally rectangular shape with planar front, rear and side panels 20, 22, 24, 26. A top panel 28 closes the top end of the hopper, with the panels 22, 24, 26 and 28 defining a coffee bean chamber 30 sized to store a supply of coffee beans 12. An access panel 32 is hingely coupled over an opening 34 formed through the top panel 28. The access panel 32 is movable to an open orientation to permit the chamber 30 to be re-filled with coffee beans 12 via the top opening 34.

The dispenser 10 has an overall height and depth selected to permit its positioning on a standard grocery store shelf. Most preferably, the panels 20, 22, 24, 26 have a vertical height h typically selected at between about 10 and 36 inches and a depth d of about 24 inches. Taller or shorter panels 20, 22, 24, 26, however, may also be used depending on the dispenser 10 placement. The hopper 14 has a preferred overall lateral width w of between about 4 and 12 inches, and more preferably about 6 to 8 inches. By forming the front and rear panels 20, 22 with a lateral width of between about 6 and 8 inches in width, a number of dispensers 10 maybe positioned as a side-by-side array on a grocery store shelf 35 (FIG. 1).

Figure 2:
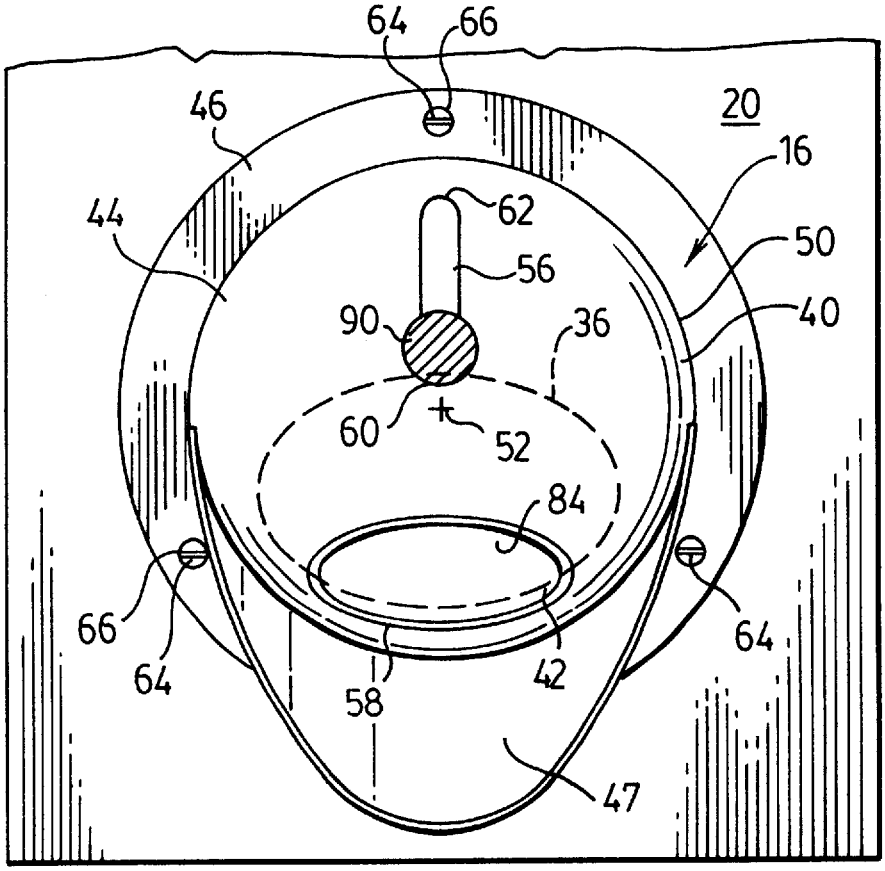
FIG. 2 shows an enlarged front view of the dispensing mechanism mounted to the dispenser of FIG. 1 with the dispensing mechanism gate moved to an open position.

FIGS. 1 and 2 show best the front panel 20 as having an exit orifice 36 (shown in phantom) formed therethrough, and which opens into a bottom portion of the chamber 30. As will be described hereafter, the dispensing mechanism 16 is coupled to the front panel 20 in a position completely overlying the exit orifice 36, whereby the dispensing mechanism 16 is operable to regulate the movement of coffee beans 12 from the chamber 30.

Figure 3:
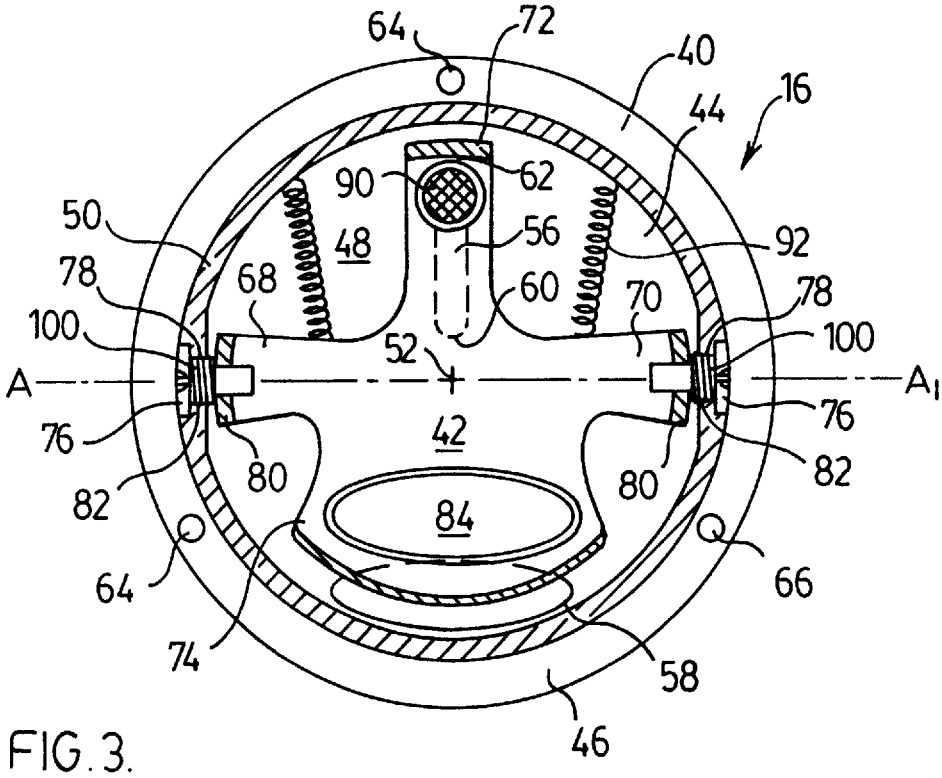
FIG. 3 illustrates a rear view of the dispensing mechanism shown in FIG. 2 with the dispensing mechanism gate moved in a closed position.

FIGS. 2 and 3 show the dispensing mechanism 16 best as including an outer housing 40 and an inner gate member 42. The outer housing 40 is fixedly secured to the front panel 20 and includes a generally semi-spherical cover 44, an anchoring flange 46 and a bean chute 47 used to direct dispensed coffee beans 12 away from the hopper 14. The cover 44 is generally semi-spherical in shape defining a hollow semi-spherical interior 48 (FIG. 3) and extends forwardly from a rearwardmost peripheral edge 50 along an arc of approximately 180° to a forwardmost apex 52. The radial diameter of the cover 44 is selected larger than that of the exit orifice 36, enabling the cover 44 to be secured in position completely overlying the exit orifice 36. FIG. 2 shows best the cover 44 as including a slot 56 and an outlet opening 58. The outlet opening 58 formed in a lower portion of the cover 44, spaced at least partially and preferably wholly below the apex 52. The outlet opening 58 is most preferably formed having a generally oval shape, elongated in a lateral direction. The lateral width of the opening 58 is at least 1.5 times and more preferably, approximately twice dimension of the opening 58 in the direction of gate member 42 movement and which is normal thereto. The lateral width of the opening 58 is preferably selected at approximately 2 inches, with the opening having an overall area of between about 1.6 and 2.2 square inches, and more preferably about 1.8 square inches. Smaller or larger openings may however, be provided depending on the goods to be dispensed. FIG. 2 shows best the cover 44 as including a radially extending slot 56. The slot 56 is elongated in a direction generally perpendicular to the lateral extent of the hopper 14 and plane of the front panel 20. The slot 56 extends from a forwardmost first end 60 which is spaced at or towards the cover apex 52, rearwardly to a rearwardmost second end 62. The end 62 is spaced towards the peripheral edge 50 and is positioned so as to locate substantially vertically above the forwardmost end 60.

The flange 46 is formed as a ring-shaped member and extending radially outwardly from the peripheral edge 50 of the cover 44. The dispensing mechanism 16 is secured in place by driving screws 64 through bore holes 66 formed in the flange 44 and into the front panel 20. The bean chute 47 is secured to the flange 46 so as to extend forwardly therefrom directly beneath the outlet opening 58. The bean chute 48 may be secured to the flange 46 in any conventional manner, including by welding or by a mechanical tab/slot fit arrangements.

Figure 4:
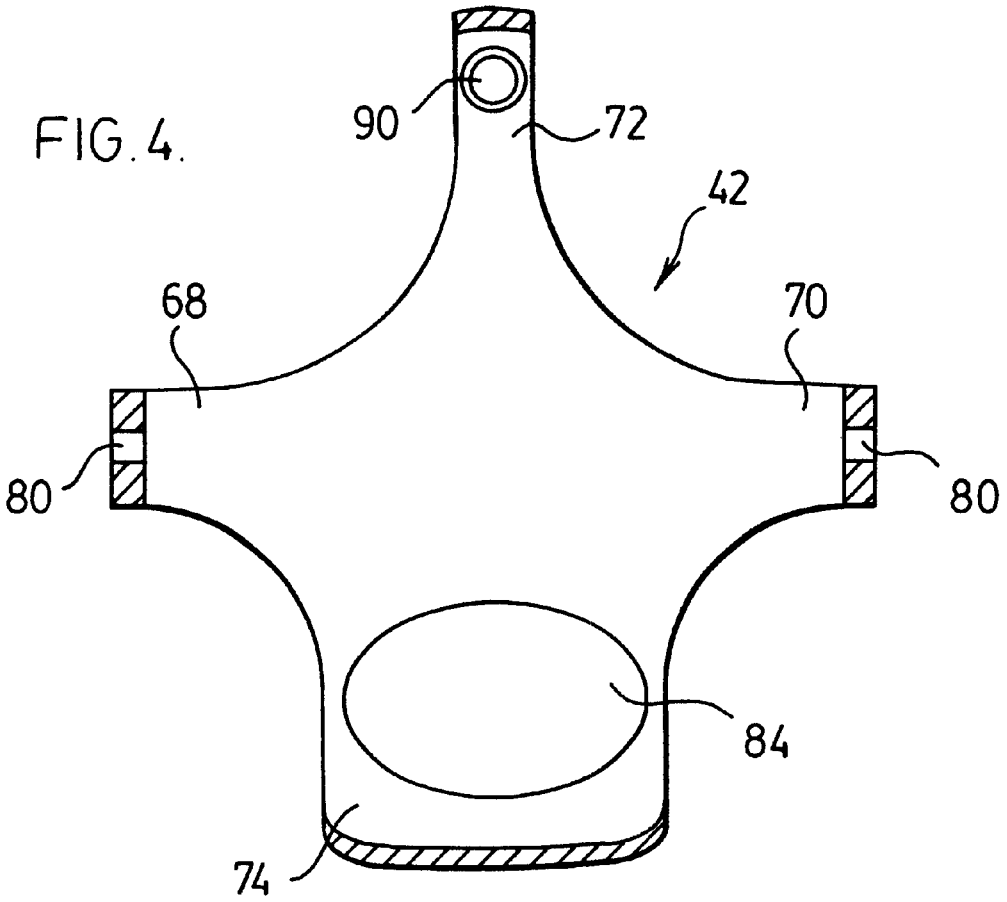
FIG. 4 is a perspective view of the gate shown in FIG. 3.

FIGS. 3 and 4 show best the securement of the gate member 42 within the interior 48 of semi-spherical cover 44. As will be described, the inner gate member 42 is secured in place so as to be selectively movable relative to the outer housing 40 to activate the dispensing mechanism 16. The gate member 42 is formed having an overall curvature which generally corresponds to the curvature of the semi-spherical cover 44, and extends radially in the lateral direction along an arc of approximately 180°, approximating to the arc of curvature of the cover 44. The gate member 42 includes a pair of arms 68, 70, a downwardly projecting tongue portion 72 and an upwardly projecting finger 74. The arm portions 68, 70 extend in the lateral direction, and curve in an orientation substantially following the curvature of the cover 44. The tongue portion 72 and finger 74 extend approximately perpendicular to the arms 68, 70, curving in an arc substantially corresponding to the curvature of the cover 44.

FIG. 3 shows best the arms 64, 66 as curving laterally towards the peripheral edge 50 of the cover 44. The gate member 42 is pivotally secured to the cover 44 by the insertion of threaded pivot pins 76 through an associated and aligned complementary sized bore holes 78, 80 formed in the cover 44 and gate member arms respectively. The bores holes 80 are formed through opposing side portions of the gate member 42 and cover 44 so as to be substantially aligned with a horizontal lateral axis $A–A_1$ of the dispensing mechanism 16. Optionally, bushings 82 may be used to facilitate the free pivoting movement of the gate member 42 relative to the housing 44. A through opening 84 is provided through the gate member tongue 72. The opening 84 has a size substantially corresponding to that of the outlet aperture 58. The opening 84 is located such that when the gate members 42 pivots about the axis $A–A_1$, the through opening 84 is moved between positions substantially aligned with and spaced from the housing opening 58, so as to selectively permit or prevent the movement of coffee beans 12 therefrom.

With the gate member arms 68, 70 pivotably coupled to each lateral side of the cover 44, the finger 72 curves upwardly and rearwardly in juxtaposed alignment with the slot 56. The positioning of the finger 72 thus seals the slot 56, substantially preventing the movement of any coffee beans 12 therethrough. As the curvature of the gate member 42 approximates the curvature of the semi-spherical cover 44, the gate member 42 locates immediately adjacent to the cover and prevents coffee beans from lodging therebetween where they may otherwise cause jamming of the dispensing mechanism 16. Most preferably the finger 72 is provided with an arcuate length which is greater than the arcuate length of the slot 56, and wherein a portion of the finger 72 is maintained in underlying juxtaposition with the slot 56 as the gate member 42 is pivoted.

An elongated handle 90 is secured to the FIG. 72 so as to project outwardly through the slot 56 as is shown in FIG. 1.

FIG. 3 shows best the dispenser mechanism 16 as further including a pair of helical springs 92. The springs 92 are provided under tension, each being coupled at an end to a forwardmost portion of the respective gate arm 68, 70, and at the other end to an upper portion of the cover 44 adjacent the peripheral edge 50. The springs 92 resiliently bias the gate member 42 so as to rotate it upwardly and rearwardly about the axis $A–A_1$ until the handle 90 is moved against the second end 62 of the slot 56 with the through opening 84 out of alignment with the housing opening 58.

With the claimed construction, coffee beans 12 move under gravity from the hopper chamber 30 through the outlet orifice 36 and into the interior 48 of the dispensing mechanism 16. The activation of the mechanism 16 thereby enables the free movement of coffee beans 12 from the hopper cavity 30, through the exit orifice 36 and outwardly through the dispensing mechanism 16.

In operation, the handle 90 is moved forwardly and downwardly from the second slot end 62 against the bias of the springs 92 along the slot 56 and about the axis $A–A_1$, in a plane substantially perpendicular to the plane of the front panel 20. The movement of the handle 90 about the axis $A–A_1$ advantageously minimizes lateral forces on the hopper 14, reducing the likelihood that the dispenser 10 may tip sideways. Further the operation of the dispensing mechanism 16 by moving the handle 90 in a plane perpendicular to that of the front panel 20 minimizes the twisting forces between the flange 40 and the front panel 20 which may otherwise loosen the attachment of the screws 64.

As the handle 90 moves, the gate member 42 pivots about the axis $A–A_1$ sliding relative to the housing 44. As the handle 90 is moved downwardly to the position shown in FIG. 2, the opening 84 in the gate tongue portion 74 moves towards alignment with the housing opening 58. The gate members 42 is moved so that opening 84 is rotated fully into alignment with the housing opening 58 with the handle 90 in engaging contact with the first end 60 of the slot 56. Once the opening 84 and aperture 58 are aligned, coffee beans 12 flow freely from the dispensing mechanism interior 48 outwardly through the opening 58, under gravity and into the bean chute 47.

Following the dispensation of the desired amount of coffee 12 the handle 90 is released. Following the release of the handle 90, the resiliency of the springs 92 rotate the gate member 42 in return movement about the axis $A–A_1$, sliding the handle 90 upwardly and rearwardly in the slot 56 until the handle 90 engages the second end 62 of the slot to limit further movement of the gate member 42. In the fully returned position, the tongue opening 84 is moved out of alignment with the housing opening 58 preventing the further movement of coffee beans 12 from the dispensing mechanism interior 48.

The movement of the gate member 42 along the interior 48 of the semi-spherical cover 44 minimizes the compaction of any coffee 12 which has moved into the dispensing mechanism 16 from the hopper 14. In particular, as the gate member 42 is pivotally moved, it acts to dislocate and loosen any compacted coffee beans 12, minimizing the likelihood of blockage of the dispensing mechanism 16. Where blockage occurs, the handle 90 may be moved back and forth along the slot 56 to agitate the gate member 42 and free any coffee beans 12 trapped in the housing interior 44.

While FIG. 3 shows the gate member 42 as including a pair of lateral arms 68, 70, a finger 72 and a downwardly extending tongue portion 74, the invention is not so limited. If desired, the gate member 42 could be formed having an overall semi-spherical shape, with a curvature substantially corresponding to that of the cover 44.

Figure 5:
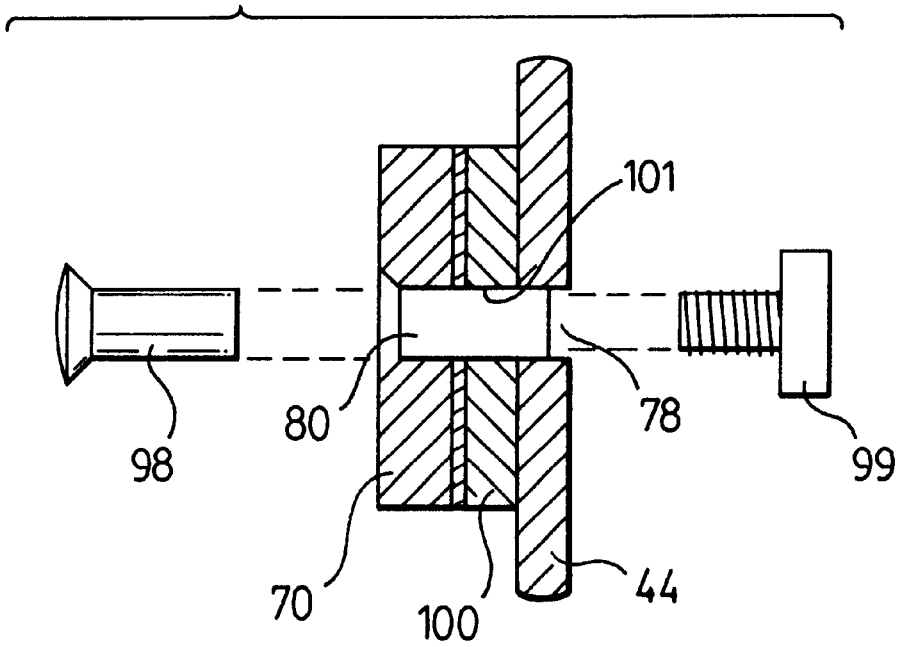
FIG. 5 shows an exploded view of the pivot connection used to secure the gate shown in FIG. 3 to the remainder of the dispensing mechanism.

FIG. 5 shows an exploded view of a preferred pivot 76 construction, wherein like reference numerals are used to identify like components. In FIG. 5 the pivot is of a two piece construction characterized by an internal threaded socket or thimble 99, and a screw portion 99 configured for threaded insertion into the thimble 98. FIG. 5 further illustrates an optional brushing 100 positioned between the arm 70 and adjacent portion of the housing 44. The brushing 100 includes a centrally formed bore 101 having a complimentary size and orientation to the aligned bores 78, 80.

Figure 6:
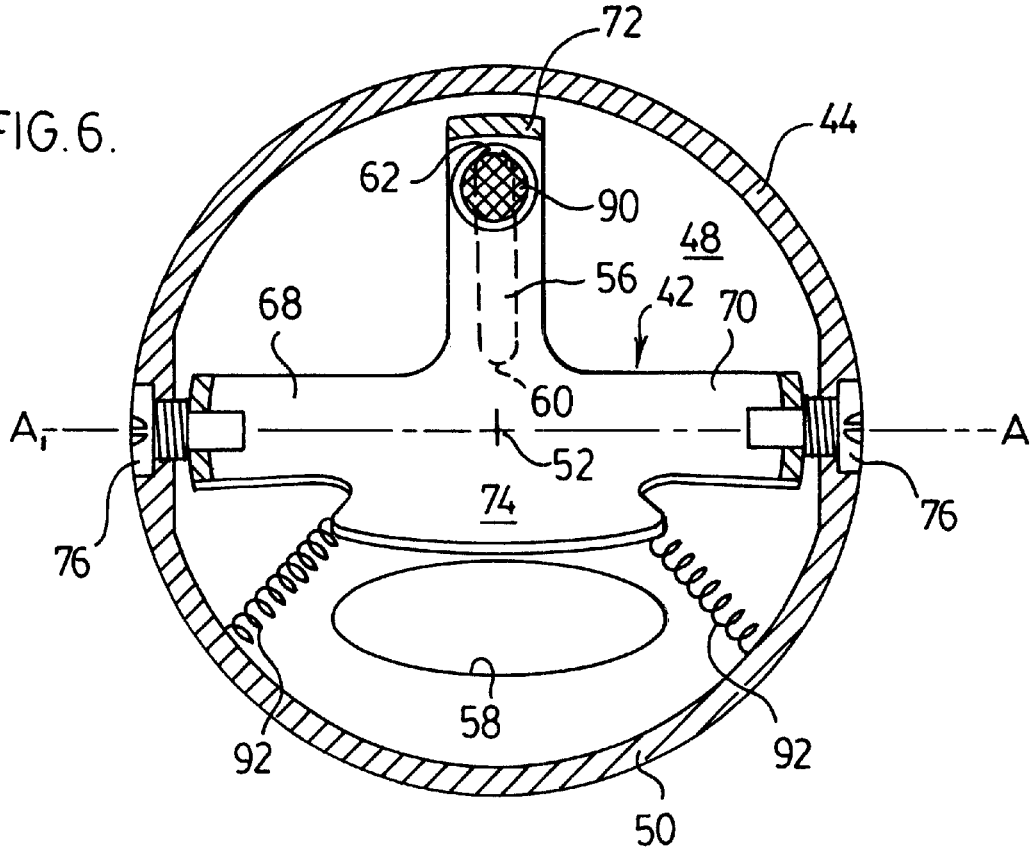
FIG. 6 shows a rear view of a dispensing mechanism in accordance with a second embodiment, with the gate member moved to an open position.
Figure 7:
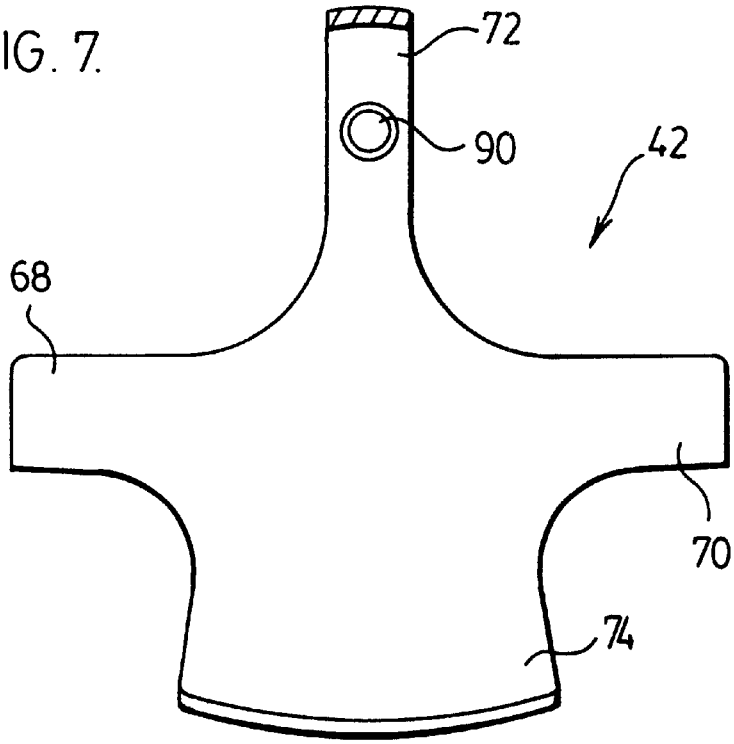
FIG. 7 shows a perspective view of a gate member shown in FIG. 6.

While FIGS. 1 to 3 show the dispensation of coffee 12 by rotating the handle 90 downwardly and forwardly about the axis $A–A_1$ towards the first end 60 of the slot 56, the invention is not so limited. If desired, the gate member 42 could be formed with dispensing mechanism 16 activated by pushing the handle 90 upwardly and rearwardly away from the apex 52. In this regard, reference may be had to FIG. 6 and 7 which show a further embodiment of the invention, and wherein like references are used to identify like components. FIG. 6 shows best a modified gate member 42 construction in which the tongue portion 74 is shortened relative to that shown in FIG. 3, and is not provided with an opening. With the dispenser 16 shown in FIG. 6, the helical springs 92 are secured at one end to the tongue portion 74 of the gate member 42, and at their other end to a lower portion of the peripheral edge 50 of the housing 44. With this configuration, the springs 92 resiliently urge the gate member 42 in rotation about the axis $A–A_1$, to a position with the tongue portion 74 overlies the housing opening 58, substantially preventing the movement of coffee therethrough, and with the handle 90 moved along the slot 56 into engagement with the forwardmost second end 60.

As with the embodiment described to reference to FIGS. 1 to 4, the gate member finger 72 ends upwardly and in an arc so as to locate in underlying juxtaposition with the slot 56, preventing the escape of coffee beans 12 therethrough.

To dispense coffee beans 12, the handle 90 is pivoted rearwardly upward from the second end 60 of the slot 56 which is closest the apex 52 towards the first end 62. The movement of the handle 90 rotates the gate member 42 in an upward arc about the horizontal axis $A–A_1$, so that the tongue portion 74 slides substantially clear of the housing opening 58. As with the first embodiment, the movement of the tongue portion 74 out of alignment with the housing opening 58 permits the free flow of coffee beans from the hopper 30 (FIG. 1) through the interior 48 dispensing mechanism housing 44, and outwardly through the opening 58.

Following the dispensation of the desired volume of coffee beans, the handle 90 is released. The springs 92 secured to the lower edge of the gate arms 68, 70 contract to resiliently return the gate member 42 to the position with the tongue portion 74 substantially covering the opening 58, and with the handle 90 engaging the forwardmost slot end 60.

Although the preferred embodiment of the invention describes the operation of the dispenser 10 in the storage and dispensation of coffee beans 12, the invention is not so limited. The dispenser 10 could also be used to store any number of food items including other foodstuffs, candies, grain and the like.

While the Figures illustrate the hopper 14 as having a generally rectangular shape housing, other housing configurations, including square or cylindrical shaped housing, are also possible and will now become apparent.

Although the detailed description describes and illustrates various preferred embodiments of the invention, the invention is not so limited. Many modifications and variations will now occur to persons skilled in the art. For a definition of the invention, reference may be had to the appended claims.

I claim:

1. In combination a hopper for storing coffee and a dispenser mechanism for dispensing coffee from said hopper, the hopper defining a chamber and an exit orifice leading from said chamber, the dispenser mechanism including, a cover member including a generally semi-spherical portion and peripherally extending flange extending radially from a peripheral edge the semi-spherical portion, the semi-spherical portion extending from the peripheral edge to an apex, the cover member being sized to substantially cover said exit orifice with the peripheral edge being secured about said exit orifice, said semi-spherical shaped portion further including a slot and a discharge opening formed therethrough, said slot extending radially from a first end spaced towards said peripheral edge to a second end spaced towards said apex, said opening being spaced from said slot and sized to permit substantially unrestricted movement of said coffee therethrough, an actuating member disposed intermediate said semi-spherical portion and said hopper, said actuating member being pivotally coupled to said cover member and being movable between a first position wherein at least part of said actuating member substantially overlies and closes said opening, and a second position wherein said part of said actuating member is at least partially spaced from said opening, a handle extending through said slot, and being coupled to the actuating member, whereby the sliding movement of the handle along with slot between the first and second ends selectively moves the actuating member between said first and second positions.

2. The combination as claimed in claim 1 further including a biasing member for resiliently biasing said actuating member to said first position.

3. The combination as claimed in claim 1 wherein said slot extends across upwardmost facing portion of said semi-spherical portion, and said outlet is formed in a vertically downward facing portion of said semi-spherical portion.

4. The combination as claimed in claim 1 wherein said actuating member has a curvature substantially corresponding to the curvature of said semi-spherical portion, wherein the actuating member is substantially maintained in juxtaposition with an interior surface of said semi-spherical portion as said actuating member is moved between said first and second positions.

5. The combination as claimed in claim 2 wherein when said actuating member is in said first position, said handle is spaced towards said first end of said slot.

6. The combination as claimed in claim 2 wherein when said actuating member is in said first position, said handle is spaced towards said second end of said slot.

7. The combination as claimed in claim 5 wherein said biasing member comprises a tensioned spring.

8. The combination as claimed in claim 1 wherein said actuating member is pivotal about a substantially horizontal axis.

9. The combination as claimed in claim 8 wherein said hopper further includes a generally planar front panel, said exit orifice being formed through said front panel, and wherein said horizontal axis is generally parallel to the planar orientation of said front panel.

10. The combination of claim 1 wherein the actuating member includes a curved finger portion sized for underlying juxtaposition with said slot as said actuating member is moved between said first and second positions.

11. A dispenser for dry foodstuffs comprising a hopper for storing said foodstuffs and a dispenser mechanism, the hopper including a chamber and an exit orifice leading from said chamber, the dispenser mechanism including, a cover member including a generally semi-spherical portion and peripherally extending flange, the semi-spherical portion extending radially from the peripheral edge to an apex, the cover member being sized to substantially cover said exit orifice with the peripheral edge of said cover member being secured about said exit orifice, said semi-shaped portion further including a slot and an opening formed therethrough, said slot extending radially from a first end spaced towards said peripheral edge to a second end spaced towards said apex, said opening being spaced from said slot and sized to permit substantially unrestricted movement of said coffee therethrough, an actuating member disposed intermediate said semi-spherical portion and said hopper, said actuating member being pivotally coupled to said cover member and being movable between a first position wherein at least part of said actuating member substantially overlies and closes said opening, and a second position wherein said part of said actuating member is at least partially spaced therefrom, a handle extending through said slot and coupled to the actuating member, whereby the selective sliding movement of the handle along with slot between the first and second positions moves the actuating member.

12. A dispenser as claimed in claim 11 wherein said foodstuff is selected from ground coffee beans, whole coffee beans and mixtures thereof.

13. A dispenser as claimed in claim 11 wherein said actuating member is pivotal about a substantially horizontal axis.

14. A dispenser as claimed in claim 11 wherein the actuating member includes a curved finger portion sized for underlying juxtaposition with said slot as said actuating member is moved between said first and second positions.

15. A dispenser as claimed in claim 11 wherein said actuating member has a curvature substantially corresponding to the curvature of said semi-spherical portion, wherein the actuating member is substantially maintained in juxtaposition with an interior surface of said semi-spherical portion as said actuating member is moved between said first and second positions.

16. A dispenser as claimed in claim 11 wherein said opening is generally oval I shape having a width in a lateral direction which is approximately twice that in a direction normal thereto.

17. A dispenser as claimed in claim 16 wherein said opening has an area of between about 1.6 and 2.2 square inches.

18. The combination as claimed in claim 1 wherein said opening is generally oval in shape having a width in a lateral direction which is approximately twice that in a direction normal thereto.

19. The combination as claimed in claim 18 wherein said opening has an area of between about 1.6 and 2.2 square inches.

* * * * *